US005296126A

United States Patent [19]

Izrael

[11] Patent Number: 5,296,126

[45] Date of Patent: Mar. 22, 1994

[54] METHOD FOR PROCESSING THE ETCHED SURFACE OF A SEMICONDUCTIVE OR SEMI-INSULATING SUBSTRATE

[75] Inventor: Alice Izrael, Meaux, France

[73] Assignee: France Telecom, Paris, France

[21] Appl. No.: 873,121

[22] Filed: Apr. 24, 1992

[30] Foreign Application Priority Data

Apr. 26, 1991 [FR] France ..... 9105171

[51] Int. Cl.[5] ..... C25D 11/32

[52] U.S. Cl. ..... 205/124; 205/125; 205/157; 205/229

[58] Field of Search ..... 204/129.3, 129.75, 129.8, 204/131, 140, 146; 205/123, 157, 129, 106, 229, 124, 125

[56] References Cited

U.S. PATENT DOCUMENTS

| | | | |
|---|---|---|---|
| 3,536,600 | 10/1970 | Van Dijk et al. | 204/129.3 |
| 3,898,141 | 8/1975 | Ermanis et al. | 204/129.43 |
| 4,026,741 | 5/1977 | Chang et al. | 156/628 |
| 4,194,954 | 3/1980 | Faktor et al. | 204/129.3 |
| 5,174,870 | 12/1992 | Puma | 204/141.5 |
| 5,178,967 | 1/1993 | Rosenfeld et al. | 205/229 X |

FOREIGN PATENT DOCUMENTS 1573470 7/1969 France .

OTHER PUBLICATIONS

"Anodic oxidation of CdTe as a thin-layer removal technique", Yoshikawa et al., Journal of Applied Physics, vol. 18, No. 1, Jan. 1979.

"Repeated removal of thin layers of silicon by anodic oxidation", Journal of the Electrochemical Society, vol. 123, No. 9, Sep. 1976, Barber et al., pp. 1404–1408.

"Fabrication of Silicon Microstructures Based on Selective Formation and Etching of Porous Silicon", 1046 Journal of the Electrochemical Society 135 (1988) Aug., No. 8, Manchester, NH, USA.

"Controlled sectioning technique for small gallium arsenide samples", Magee et al., Review of Scientific Instruments, vol. 43, No. 8, Aug. 1972, pp. 1218–1220.

*Primary Examiner*—Donald R. Valentine

*Attorney, Agent, or Firm*—Longacre & White

[57] ABSTRACT

The present invention concerns a method for processing an etched surface of a semiconductive or semi-insulating substrate. It further concerns integrated circuits manufactured by this method and an anodic oxidation apparatus for implementing the method. The invention is particularly applicable to the manufacture of integrated circuits with ultrafine details (below 1μ) and in particular to manufacturing electro-optical devices. Anodic oxidation with controlled voltage and current is used to peel a constant thickness of oxidation off a surface of the substrate so as to improve the subsequent epitaxial growth.

15 Claims, 2 Drawing Sheets

FIG. 1
(PRIOR ART)
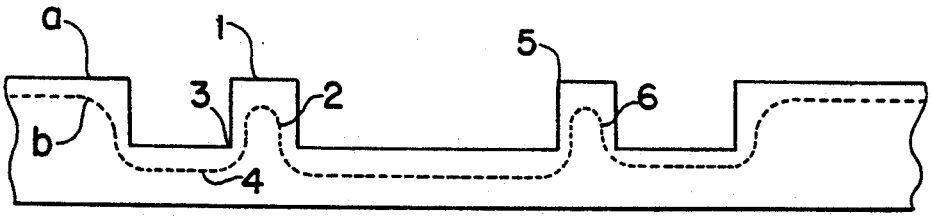
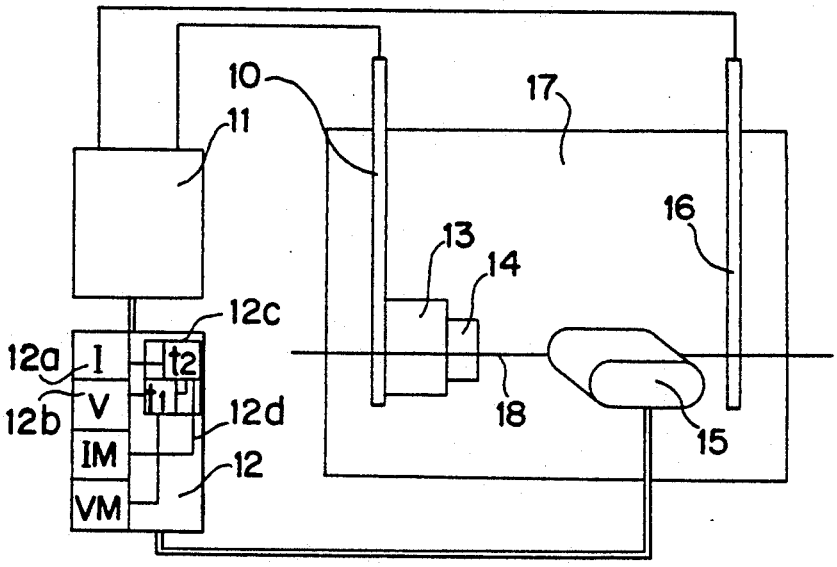
FIG. 2
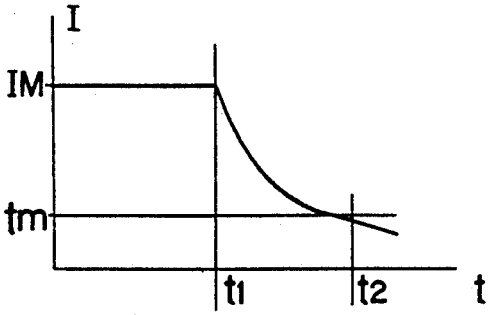
FIG. 3a
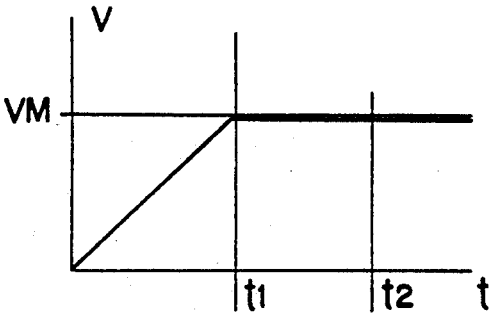
FIG. 3b

METHOD FOR PROCESSING THE ETCHED SURFACE OF A SEMICONDUCTIVE OR SEMI-INSULATING SUBSTRATE

BACKGROUND OF THE INVENTION

1. Field of the Invention

The present invention concerns integrated circuits made by a method for processing an etched surface with an anodic oxidation apparatus. The present invention is especially applicable to the manufacture of ultrafinely ($<1\mu$) detailed integrated circuits such as those used in certain electro-cptical devices.

2. Description of Related Art

A number of means are known from the prior art for processing a desired design on a semiconductive substrate. Semiconductive substrates are taken to include all manners of substrates formed by insulating layers combined with conducting layers. Chemical etching and dry engraving are two commonly known means for processing the surface of the substrate. In particular, dry engraving is preferred for precise etching of very tiny design details where accurate control of the etching depth is critical.

One drawback of these known means is the degradation of the surface of the substrate. Unless special precautions are taken, the surface is likely to be unsuitable to accept a deposit, especially an epitaxial deposit.

Treatments are also known which prepare the surfaces to accept epitaxial coatings or to resume epitaxy following etching. Generally, the surfaces are repaired by annealing in a hydrogen atmosphere, or by chemical action. One drawback of annealing is dimensional stability of the design details is difficult to control. Consequently, annealing cannot be used on designs with very minute dimensions (sub-micron size), which would likely be modified or erased during annealing.

SUMMARY OF THE INVENTION

An object of the present invention is a semiconductive or semi-insulating substrate made by a process which does not affect the basic profile of the design on the substrate.

The present invention uses anodic oxidation to overcome the drawbacks of the prior art. According to the present invention, the anodic oxidation does not produce a surface oxide coating, but rather it peels a slight thickness off the surface in a controlled manner. This peeling technique allows preparing the surface of even the most minute etched designs prior to epitaxial deposition.

Another object of the present invention is a method of processing an etched surface of a semiconductive or semi-insulating substrate, the method comprises the steps of:

immersing the substrate into an electrolytic bath, mounting a first electrode on the substrate to be processed, mounting a second electrode in the bath at a selected distance from the surface of the substrate to be processed, connecting the first and second electrodes to a source of electricity, applying specified magnitudes of current and voltage for a specified time, and at least partially removing the formed oxide by peeling away a uniform controlled thickness independent of the orientation of the treated surface.

Electrolysis is widely known in the prior art. In particular, it is known to use electrolysis to deposit a surface coating upon a substrate. Examples include depositing a metalizing coating on a rear side of a substrate, and depositing a conducting design on the last layer of an integrated circuit.

Anodic oxidation is known for making MOS devices both in silicon technology and in that of the III-V compounds (for instance AsGa or InP) and the II-VI compounds. However, to-date, this procedure has been used exclusively to either produce oxides on the surface of a substrate, or to condition the surface of a substrate prior to epitaxial growth.

In the article "Porous Silicon formation and Electropolishing of Silicon by Anodic Polarization in HF solution" (Journal of the Electrochemical Society, vol. 136, no. 5, May 1989), Zhang et al. describe anodic oxidation to reduce the thickness of porous silicon in a hydrofluoric-acid bath. In particular, characteristic curves of the current as a function of the applied voltage (I/V) are researched in relation to the hydrofluoric-acid concentration.

Zhang et al. describe a counter electrode in the form of a platinum grid, and a saturated-calomel reference electrode, both of which are mounted vertically in an electrochemical cell. With this arrangement, it is possible to retain a specific thickness of porous silicon. However, this technique does not recognize the problem solved by the present invention, which is to process the surface of a substrate having a repeated, specific pattern. According to Zhang et al., the desired thinning of the porous silicon is a result of the chemical action of the hydrofluoric acid solely enhanced by electrical polishing. Consequently, the method proposed by Zhang et al. is applicable only to large surfaces lacking relief details that would be substantially erased by the chemical action of the hydrofluoric acid.

The article "Electrochemical Treatment of Epitaxial Gallium Arsenide Structures in Integrated Circuit Technology" (translated from the Russian Elektrokhimia, vol. 25, no. 4, pp 525–8, April 1988) describes a local etching procedure through a mask. Again, it is impossible to use this method to process a surface with repeated, fine-detail, geometric patterns.

Yet another object of the invention is an apparatus for anodic oxidation which allows the surface of an already etched layer to be peeled without erasing the finer details.

A further object of the present invention is an anodic oxidation apparatus wherein the substrate to be processed is mounted on a counter-electrode so as to create isotropic equipotentials which even the surface peeling thickness, regardless of the local surface orientation or its position on the substrate.

A yet further object of the invention is an integrated circuit comprising a first etched layer having a design incorporating ultrafine (below $1\mu$) details which is processed according to the present invention.

In a reasonable variation, the aforementioned integrated circuit further comprises a second etched layer adjacent and upon the first etched layer. In a preferred implementation, a multi-layer substrate such as a silicon chip having a series of integrated circuits comprises at least one layer processed according to the present invention.

Other features and advantages of the present invention are elucidated further below in relation to the following description and drawings.

BRIEF DESCRIPTION OF THE DRAWINGS

FIG. 1 is a cross-section of a layer etched in a known manner, before and after surface processing according to the prior art.

FIG. 2 is a schematic diagram of an apparatus according to the present invention.

FIGS. 3*a* and 3*b* show representative plots as a function of time for the current and voltage, respectively, during processing in the apparatus of FIG. 2.

DESCRIPTION OF THE PREFERRED EMBODIMENTS

Figure 4A:
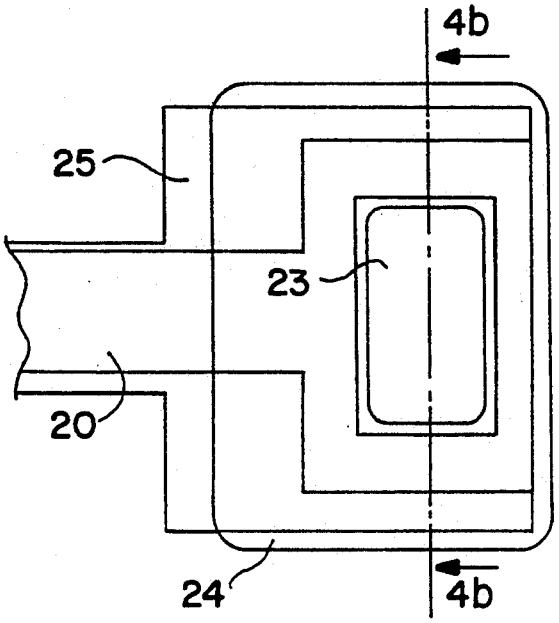
FIGS. 4*a* and 4*b* are orthogonal schematic and section views, respectively, of a detail of the apparatus of FIG. 2.

FIG. 1 shows a cross-section of a layer in solid lines (a) following a prior etching stage and the same layer in dashed lines (b) following subsequent chemical treatment. Etching makes very sharp, precise details such as the partitions 1 and 5. However, surface processing by immersion in a chemical treatment bath erodes the sharp details of the pattern, and in extreme cases, the finest details of the layer are erased. As shown in FIG. 1, erosion by the chemical action transforms the partitions 1,5 into a mere corrugations 2,6 by effectively erasing the sharp edges of the details.

Generally, the residual height following chemical treatment is greater for wider than finer details, and this may yield acceptable results provided the design detail on the lower layer is sufficiently large to support successive additional layers thereon.

On the other hand, as integration increases or if it is desired to integrate optical devices, minimization of the size of details such as the partitions 1,5 is so drastic that the entire design will be lost if the prior art is employed.

The anodic oxidation apparatus of the present invention uses the electrodes with the geometries schematically shown in FIG. 2 to create electric field lines which are substantially perpendicular to the surface to be processed. Consequently, the equipotentials are isotropicly distributed on the surface being processed. This produces the peeling effect, or substantially constant dimensional paring, but only in the peeling direction, i.e. along the electric field lines.

Accordingly the sharp angles of the details are not rounded off as they would be by the prior art.

Referring to FIG. 2, the anodic oxidation apparatus of the present invention comprises a bath 17 filled with an electrolytic solution slightly enriched in $H_3O+$ ions, i.e., it will generally be an acid solution.

In a preferred implementation of the invention, this electrolytic solution consists of ethylene-glycol and 0.5% dilute ortho-phosphoric acid in a 2:1 volume ratio. By changing:

1) the bath composition, in particular by changing the ratio proportions, 2) the acidity or pH of the bath, or 3) the nature of the acid or solvent, the relation between the oxide layer formed and the maximum applied voltage may be advantageously varied.

Owing to the presence of the electrolyte ions, an oxide layer is formed on the surface and thereafter peeled by the method described below. This oxide layer is used in the manufacture of complex integrated circuits.

In the case of integrated circuits for electro-optic applications, e.g. quantum-wire lasers, the oxidized surface must be carefully acid-stripped following electrolysis. The dissolution of the oxide by a suitable reagent, which is relatively inert to the un-oxidized material underneath, improves the physical properties of the processed surface obtained following peeling. It is therefore possible to resume epitaxial growth, i.e. a second epitaxial growth following etching. Illustratively, when an epitaxial layer is added, the physical compatibility of the mutually facing surfaces must be improved so as to minimize the formation of gaps in the matter, i.e. interstices, when epitaxial growth resumes. These gaps degrade performance of the integrated circuit and, in the extreme, may cause the integrated circuit to malfunction. This aspect of the present invention is highly useful in making electro-optical components.

FIG. 2 shows two electrodes 10,16 immersed in the bath 17. The electrodes 10,16 are connected to a voltage-limited and current-regulated power supply 11,12.

An advantageous aspect of the present invention is that the anode 10 is configured in such a way that the semi conductive substrate 14 to be processed by the inventive process is positioned coincident with an equipotential surface. Conductive fastening means 13 provides mounting for the substrate 14 on the conductive plate 10. Axis 18 which is perpendicular to the equipotential surface indicates that the two electrodes 10 and 16 are oppositely positioned.

Referring now to FIGS. 2, 3*a* and 3*b*, the electrodes 10,16 are connected to the output terminals of a controlled current generator. During a first stage of the processing ($0<t<t1$) the current generator provides a constant output IM and voltage rises to its maximum permissible voltage VM, as is determined in a manner described below.

When processing begins, the anodic oxidation starts over the entire surface because it is also an equipotential surface. Increasing voltage substantially linearly causes a smooth increase in the thickness of the anodic oxidation layer, regardless of the position on, or the orientation of the surface. This advantageous feature of the invention makes it possible to preserve the etched design on the processed surface from erasure even when the sizes of the design details are quite small.

In one implementation of the present invention, processing is stopped at such time t2 as several criteria are met. As an illustrative example of possible criteria for terminating processing, it may be appropriate to halt processing if at least one of the following two conditions is met:

when the current into the electrolytic bath reaches a predetermined value Im which is one-tenth the magnitude IM set during the first stage of anodic oxidation, and when the current drops after time t1 in smooth manner over an interval t2 which is at least twice the interval t1.

Regularity of the drop in current during the second processing stage ($t1<t<t2$) may be only one of the criteria, however, a rise in the current after a drop (i.e. a current leak) denotes processing defectiveness.

In the present invention, the maximum current IM is determined in relation to the size of the substrate being processed, and as a function of the permissible current density which is based on the length of the processing interval t2 and the nature of the electrolyte.

Oxidization thickness is also determined as a function of the maximum voltage to which the current generator, and of the nature of the electrolyte.

In one preferred embodiment of the present invention, the current generator 11 is connected to a control circuit 12. This control circuit 12 comprises a circuit 12*a* measuring the current I flowing through the electrolytic bath 17, and a circuit 12*b* measuring the instantaneous voltage V across the terminals of the electrodes 10,16. The measurements of the current I and voltage V are used for the following purposes:

to limit the voltage to a predetermined value VM, and to regulate the current to a predetermined value.

The control circuit 12 also includes a circuit 12*c* measuring the processing times t1,t2, and a means 12*d* for analyzing the predetermined process termination criteria. The processing time measuring circuit 12*c* may comprise a clock which is triggered when electrolysis starts. The time t1 is recorded when the voltage V, measured by the circuit 12*b*, has reached the predetermined value VM. Time t2 is determined when the current I, measured by the circuit 12*a*, has reached the predetermined value, e.g. Im=IM/10.

The circuit 12*d* analy the predetermined termination criteria at each instant compares the elapsed time from the start of oxidation to a magnitude t2 determined at t1, the end of the first stage, e.g. t2=2 t2. In one embodiment mode, the predetermined termination criteria are analyzed by a microprocessor and a coded program of the method of the present invention.

In a subsequent stage, the substrate is withdrawn from the electrolytic bath and the oxide is removed with a specific reagent which is inert to the un-oxidized material underneath. In a preferred implementation, the selected acid is 50% diluted hydrochloric acid for a GaAs substrate, and pure hydrofluoric acid for an InP substrate. Finally, the processed substrate is rinsed with a rinsing solution such as de-ionized water.

In a later stage of the full manufacturing process for the integrated circuit made by the method of the present invention, the method may be repeated to deposit, illustratively by epitaxial growth, an additional layer without incurring formation of a gap or an interface defect between the two materials.

In a preferred implementation of the invention, the anode 10 supports the substrate to be peeled and oxidized, and the electrode 16 opposite the anode is made of a material which is inert to electrolysis, e.g. platinum prepared for an electrolytic bath.

In a preferred implementation, the current density is from 0.1 to 0.5 ma/cm$^2$ at a maximum voltage VM of 30 v and for an interval t1 of 2 to 10 minutes.

The anodic oxidation apparatus of the present invention also comprises a means 15 for providing an activation energy to the substrate from the outside of its surface in order for the substrate to become more conductive. The objective being to increase the conductivity of GaAs or the like, thus, anodization becomes easier. In the preferred implementation, the means for activating the design is a light source radiating in the visible spectrum from 650 to 800 nm and transmitted by fiber optics to the surface of the substrate being processed.

In one embodiment mode, light source 15 is controlled by a circuit 12*e* of the control circuit 12.

Figure 4B:
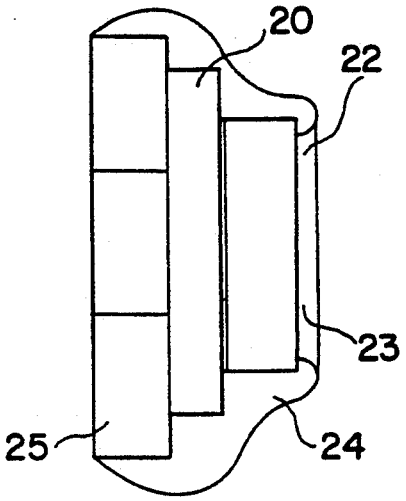

FIG. 4 shows a preferred embodiment of the means for supporting the integrated circuit(s) being processed on the anode 10. The supporting means comprises an insulating plate 25, possibly made of alumina $Al_2O_3$. A conducting plate 20 affixed to the insulating plate 25 serves as a mechanical support as well as being connected the current generator 11. In one embodiment, it is desirable to make the conducting plate 20 out of gold (Au).

The substrate 23 to be processed is affixed on the conducting plate 20 by a conductive fastener or adhesive.

The portion of the surface subject to anodic oxidation may be limited by imbedding areas to be protected under an insulating resin.

The other electrode 16 provides an active face substantially parallel to the anode 10.

Once processed, the substrate is removed from the electrolytic bath 17 and rinsed with a solution such as de-ionized water.

The results of the processing may be checked with a color-iridescence test showing the thickness of the oxidation and its homogeneity. If the results of the check are positive, the integrated circuits are passed on to further manufacturing steps.

The present invention is readily automated, for instance automated control of the current and voltage provides great accuracy in making oxidation thicknesses. Further, analysis of the color iridescent check of the substrate can be automated using a camera linked to an analyzer as is well known to those of ordinary skill in the art. Alternatively, thickness checking can be accomplished with an ellipsometer.

The method of the invention is applicable to wafers which may comprise a large number of integrated circuits which will be separated before the end of manufacture.

Moreover the invention concerns an integrated circuit manufactured by the method and apparatus described above. Such an integrated circuit comprises at least one microstructure of which the surface has been peeled. This surface may or may not be buried under a subsequent layer upon resumption of epitaxial growth.

Figure 5A:
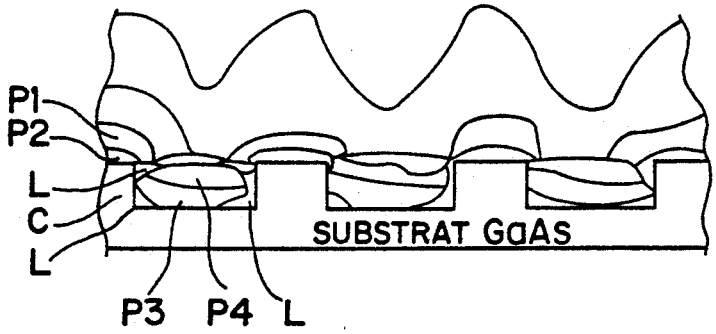
FIGS. 5*a* and 5*b* are schematic views of micrographs for a sper lattice GaAs circuit without anodic oxidation (FIG. 5*a*) and with anodic oxidation (FIG. 5*b*).
Figure 5B:
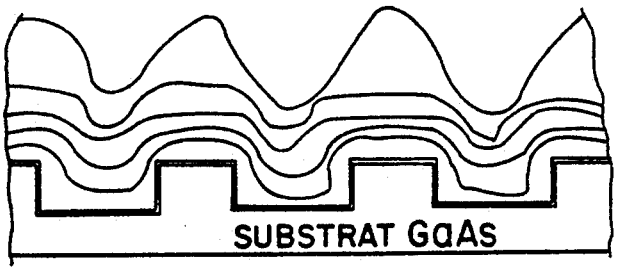

In a first mode of implementation, a GaAs substrate was etched into a periodic structure consisting of 0.6$\mu$ wide and 0.25$\mu$ deep pans separated by partitions about 20 nm thick. FIGS. 5*a* and 5*b* show micrographs of a large scale integrated circuit sample on GaAs without anodic oxidation (FIG. 5*a*), and with anodic oxidation followed by peeling (FIG. 5*b*). The sample was epitaxially grown by the MOCVD procedure (vapor-phase chemical deposition) of a complex compound 3x(AlAs/GaAs) of which the layers P1 through P4 are shown on a substrate C.

Anodic oxidation was carried out at a maximum current density of 0.2 ma/cm$^2$ and at a maximum voltage of 20 volts. With a GaAs substrate, the peeled thickness is about 0.7 nm per applied volt. In FIG. 5*b*, the peeling thickness is indicated by a fine line above the thick line, and represents the peeling thickness that was entirely covered a subsequent epitaxial growth layer.

Before this epitaxial growth, the oxide made on the electrolytically processed surface (shown by the fine line) is removed (as far as the thick line), as described above.

In FIG. 5*a*, epitaxial growth results in interstices L which are widely avoided in FIG. 5*b* as a result of the present invention.

In another implementation, a microstructure similar to that of either FIG. 5*a* or FIG. 5*b* was made on an InP semiconductive substrate. The maximum applied voltage was 10 v.

In practice the integrated circuit is made from a wafer of a semi-conducting or semi-insulating material.

The present invention is limited in scope only by the claims appended hereto. The exemplary embodiments and implementations described above are identified merely for the purpose of explaining aspects of the present invention and should not be construed as limitations upon the scope of the claimed subject matter.

What is claimed is:

1. A method of processing an etched surface of a semiconductive or semi-insulating substrate, the method comprises the steps of:

immersing the substrate into an electrolytic bath, mounting a first electrode on the substrate to be processed, mounting a second electrode in the bath at a selected distance from the surface of the substrate to be processed, connecting the first and second electrodes to a source of electricity, applying specified magnitudes of current and voltage for a specified time, and at least partially removing a formed oxide by peeling away a uniform controlled thickness independent of the orientation of the processed surface.

2. The method according to claim 1, wherein the electrolytic bath comprises is a solution enriched in $H_3O+$ ions.

3. The method according to claim 2, wherein the first electrode is an anode adapted to support the surface of said substrate coincident with an equipotential surface.

4. The method according to claim 3, wherein a first stage of processing comprises a first time interval during which the current flowing through the electrolytic bath is maintained at a constant maximum level and the voltage across the electrodes increases to a limit value, and a subsequent second stage of processing comprises a second time interval during which the voltage across the electrodes is maintained at a constant value.

5. The method according to claim 4, wherein processing is terminated at the end of said second stage based upon achieving at least one of two conditions:

when the current flowing through the electrolytic bath reaches a predetermined value equivalent to one tenth the maximum current during the first stage of anodic oxidation, and when the current flowing through the electrolytic bath drops after completion of the first stage over a time interval at least equivalent to the time interval of the first stage.

6. The method according to claim 4, wherein the maximum current is determined based upon at least the permissible current density of the surface to be processed, which in turn is determined based upon the sum of the time intervals for said first and second stages of processing duration and of the composition of the electrolyte.

7. The method according to claim 5, wherein oxidized thickness is determined based upon the maximum voltage across the electrodes and the composition of the electrolyte.

8. The method according to claim 1, wherein a means for providing an activation energy to said substrate charges said surface at least during one of said first and second stages of processing.

9. The method according to claim 1, wherein the substrate is treated with a suitable reagent adapted for de-oxidation which is inert to un-oxidized material, and thereafter rinsed with a rinsing solution such as de-ionized water.

10. The method according to claim 9, wherein a 50% dilute hydrochloric acid is the reagent for a GaAs substrate.

11. The method according to claim 9, wherein a pure hydrofluoric acid is the reagent for an InP substrate.

12. The method according to claim 1, wherein at least one integrated circuit surface is peeled without erasing details of a design etch on the surface.

13. The method according to claim 12, wherein said at least one surface is embedded in a plurality of surfaces.

14. The method according to claim 13, wherein a plurality of separate integrated circuits are manufactured on a single wafer.

15. The method according to claim 12, wherein an integrated circuit on said at least one integrated circuit surface is a component of an electro-optical device.

* * * * *